US009316035B2

(12) United States Patent
Ng

(10) Patent No.: US 9,316,035 B2
(45) Date of Patent: Apr. 19, 2016

(54) BLIND HINGE USED FOR FURNITURE

(71) Applicant: GUANGDONG TAIMING METAL PRODUCTS CO. LTD, Foshan, Guangdong (CN)

(72) Inventor: Tai Wai Ng, Foshan (CN)

( * ) Notice: Subject to any disclaimer, the term of this patent is extended or adjusted under 35 U.S.C. 154(b) by 42 days.

(21) Appl. No.: 14/286,852

(22) Filed: May 23, 2014

(65) Prior Publication Data

US 2014/0373309 A1 Dec. 25, 2014

(51) Int. Cl.

| | |
|---|---|
| ***E05F 1/08*** | (2006.01) |
| ***E05D 7/04*** | (2006.01) |
| *E05D 5/02* | (2006.01) |

(52) U.S. Cl.

CPC ..... *E05D 7/0407* (2013.01); *E05D 5/0276* (2013.01); *E05Y 2900/20* (2013.01); *Y10T 16/5389* (2015.01)

(58) Field of Classification Search

CPC ..... E05Y 2900/20; E05Y 2900/202; E05Y 2900/204; E05Y 2900/208; E05Y 2201/20; E05Y 2201/21; E05F 5/006; E05F 5/02; E05D 11/1021; E05D 11/1042; E05D 11/105; E05D 11/1064; E05D 7/04; E05D 7/0407; E05D 7/125; E05D 3/142

USPC ..... 16/286, 287, 288, 296, 294, 262, 387, 16/50, 54, 56, 237, 238, 236, 240, 245

See application file for complete search history.

(56) References Cited

U.S. PATENT DOCUMENTS

| | | | | |
|---|---|---|---|---|
| 6,088,879 | A * | 7/2000 | Gasser | 16/257 |
| 6,643,895 | B1 * | 11/2003 | Domenig et al. | 16/238 |
| 6,647,591 | B1 * | 11/2003 | Domenig et al. | 16/242 |
| 6,694,567 | B1 * | 2/2004 | Domenig et al. | 16/238 |
| 6,845,544 | B2 * | 1/2005 | Hofer | 16/246 |
| 6,918,158 | B2 * | 7/2005 | Isele | 16/235 |
| 7,117,561 | B1 * | 10/2006 | Domenig et al. | 16/236 |
| 7,213,300 | B1 * | 5/2007 | Domenig et al. | 16/236 |
| 7,231,691 | B1 * | 6/2007 | Domenig et al. | 16/236 |
| 7,516,516 | B2 * | 4/2009 | Wu | 16/242 |
| 7,653,967 | B2 * | 2/2010 | Lowe et al. | 16/238 |
| 8,650,711 | B1 * | 2/2014 | Chen et al. | 16/54 |
| 8,683,652 | B2 * | 4/2014 | Hagspiel | 16/238 |
| 8,689,402 | B2 * | 4/2014 | Brunnmayr | 16/296 |
| 2004/0163211 | A1 * | 8/2004 | Rucker | 16/235 |

(Continued)

FOREIGN PATENT DOCUMENTS

| | | | |
|---|---|---|---|
| CN | 201343946 | Y * | 11/2009 |
| CN | 102536019 | A * | 7/2012 |

(Continued)

*Primary Examiner* — Chuck Mah

(74) *Attorney, Agent, or Firm* — Maier & Maier, PLLC

(57) ABSTRACT

A blind hinge used for furniture, comprising a movable cup seat provided on the furniture door body, a regulating base provided on the main body of furniture, a rotary arm connected between the movable cup seat and the regulating base as well as an torsion spring designed to generate start-stop acting force on the movable cup seat at least, wherein two torsion springs are respectively mounted on the notches on both sides at the bottom of the movable cup seat; The torsion spring at least comprises a first supporting leg with one end extending into the cup body of the movable cup seat and being connected with it as well as a second supporting leg with another end being extended into the cup body of movable cup seat and being connected with the rotary arm.

16 Claims, 6 Drawing Sheets

(56) References Cited

U.S. PATENT DOCUMENTS

| | | | | |
|---|---|---|---|---|
| 2005/0229360 | A1* | 10/2005 | Lowe | 16/335 |
| 2006/0236503 | A1* | 10/2006 | Migli | 16/236 |
| 2007/0251057 | A1* | 11/2007 | Lautenschlager | 16/284 |
| 2012/0126677 | A1* | 5/2012 | Ahlfeld | 312/326 |
| 2012/0167343 | A1* | 7/2012 | Wu et al. | 16/277 |

FOREIGN PATENT DOCUMENTS

| | | | |
|---|---|---|---|
| CN | 102587779 | A * | 7/2012 |
| CN | 202431094 | U * | 9/2012 |

* cited by examiner

BLIND HINGE USED FOR FURNITURE

NOTICE OF COPYRIGHTS AND TRADE DRESS

A portion of the disclosure of this patent document contains material which is subject to copyright protection. This patent document may show and/or describe matter which is or may become trade dress of the owner. The copyright and trade dress owner has no objection to the facsimile reproduction by anyone of the patent disclosure as it appears in the Patent and Trademark Office patent files or records, but otherwise reserves all copyright and trade dress rights whatsoever.

RELATED APPLICATION INFORMATION

This patent claims the benefit of priority to Chinese Patent Application No. 20132036499.9, filed Jun. 24, 2013, of which full contents are incorporated herein by reference.

BACKGROUND

1. Field

The present utility model relates to a blind hinge used for furniture.

2. Background of the Prior Art

On May 17, 2006, Chinese patent (patent number: CN2780937Y) disclosed a blind hinge for furniture door which can make regulation in three-dimensional direction, comprising a movable base which can be fixed on the door body, an adjustable base which can be fixed on the door frame and a rotary arm which is connected between the movable base and the adjustable base, wherein the adjustable base comprises a base plate which can be fixed on the door frame, a middle plate which is designed to slide up and down on the base plate and a upper regulating plate which is designed to slide forward or backward on the middle plate, that is to say, the base on the door frame is designed as three-layer plate structure; The plates are formed through alloy casting and then riveted with the lower-layer regulating plate through re-extrusion. Although the production process of this utility model is simple, this process brings hidden troubles to the quality of hinge. After the alloy casting has undergone re-extrusion, there are changes in the internal structure of such material, such as loose and cracking. Therefore, it is difficult to guarantee the reliability of riveting between the alloy casting and the upper-layer regulating plate, so that the hinge does not have high strength and the door sheet may easily drop. In addition, this utility model has such deficiencies as short service life, complicated structure, many required assembly parts and high manufacturing and maintenance costs. Therefore, it is necessary to make further improvement.

DESCRIPTION OF UTILITY MODEL

It is the technical objective of the present utility model to provide a blind hinge for furniture which is featured by simple and reasonable structure, reliable performance, simple assembly process, low production cost, high structural strength and good practicability, so as to overcome the deficiencies in the prior art.

A hinge used for furniture which is designed according to this objective, comprising a movable cup seat provided on the furniture door body, a regulating base provided on the main body of furniture, a rotary arm connected between the movable cup seat and the regulating base as well as an torsion spring designed to generate start-stop acting force on the movable cup seat at least, characterized in that wherein two torsion springs are respectively mounted on the notches on both sides at the bottom of the movable cup seat; the torsion spring at least comprises a first supporting leg with one end extending into the cup body of the movable cup seat and being connected with it as well as a second supporting leg with another end being extended into the cup body of movable cup seat and being connected with the rotary arm; the free end of the first supporting leg is bent, a slot hole is provided on the movable cup seat corresponding to the first supporting leg, the first supporting leg extends into the slot hole and is connected with the bottom wall of the movable cup seat.

The arm lever at one end of the rotary arm is hinged with the movable cup seat through pin shaft and forms an arc-shaped surface which is connected with the second supporting leg of torsion spring, and the top surface at another end is connected with the regulating base of the eccentric regulating rivet.

The regulating base is composed of a connecting piece and a movable plate, wherein the connecting piece is designed as L-shaped, one side of the connecting piece is connected with the rotary arm through the eccentric adjusting rivet, and another side of the connecting piece is connected with the movable plate through another eccentric regulating rivet, so as to realize the two-dimensional regulation to the furniture door body.

A first regulating hole is provided on the rotary arm, a matching hole is provided on the connecting piece corresponding to the first regulating hole, and both the first regulating hole and the matching hole are in coordinated connection through the eccentric regulating rivet; a recess is provided on the rotary arm, flanks are extended on both sides of the recess, a boss and a slide slot are respectively on the connecting piece corresponding to the recess and on the flank, and both the boss and the sliding slot are in sliding fit; A limiting bump is provided on the connecting piece corresponding to the flank.

A second regulating hole is provided at the connecting piece, a matching hole is provided on the movable plate corresponding to the regulating hole, and both the second regulating hole and the matching hole are in coordinated connection through another eccentric regulating rivet; the side walls of the connecting piece are bent inwards to form a boss, an open slot is provided on the side wall of the movable plate corresponding to the boss, and both the boss and the open slot are in sliding fit; at least two corners of the movable plate are bent downwards to form a claw.

The regulating base is composed of a connecting piece, a movable plate and a base plate, wherein the movable plate 3 is positioned between the connecting piece and the base plate, the connecting piece is designed as L-shaped, one side of the connecting piece is connected with the rotary arm through one eccentric regulating rivet, another side of the connecting piece is connected with the movable plate through another eccentric regulating rivet, and the movable plate is also connected with the base plate through another eccentric regulating rivet, so as to realize the three-dimensional regulation to the furniture door body.

A first regulating hole is provided on the rotary arm, a matching hole is provided on the connecting piece corresponding to the first regulating hole, and both the first regulating hole and the matching hole are in coordinated connection through the eccentric regulating rivet; a recess is provided on the rotary arm, flanks are extended on both sides of the recess, a boss and a slide slot are respectively on the connecting piece corresponding to the recess and on the flank, and both the boss and the sliding slot are in sliding fit; A limiting bump is provided on the connecting piece corresponding to the flank.

A second regulating hole is provided on the connecting piece, a matching hole is provided on the movable plate corresponding to the second regulating hole, and both the second regulating hole and the matching hole are in coordinated connection through another eccentric regulating rivet; the side walls of the connecting piece are bent and squeezed inwards to form a boss, an open slot is provided on the side wall of movable plate corresponding to the boss, and both the boss and the open slot are in sliding fit; a third regulating hole is provided on the movable plate, a matching hole is provided on the base plate corresponding to the third regulating hole, and both the third regulating hole and the matching hole are in coordinated connection through another eccentric regulating rivet; The outside of the base plate is bent towards the direction of the movable plate to form a guide slot, and movable plate is slideably provided on the guide slot, and at least two corners of the base plate are bent downwards to form a blocking part.

Both the rotary arm and the regulating base are molded by integrated stamping and bending of metal.

Through the improvement of the said structure, the torsion springs can be directly assembled on the movable cup seat without need for any auxiliary part, so that the present utility model can not only simplify the assembly procedures and manufacturing process, but also further reduce the product cost; In addition, a regulating base designed to make position regulation to the furniture door body is also provided in the hinge, so that the user can may regulation at will according to need. The present utility model is featured by simple and reasonable structure, reliable performance, simple assembly procedures, simple manufacturing process, low manufacturing cost, high structural strength and good practicability.

DESCRIPTION OF ATTACHED DRAWINGS

DETAILED DESCRIPTION OF PREFERRED EMBODIMENTS

Figure 1:
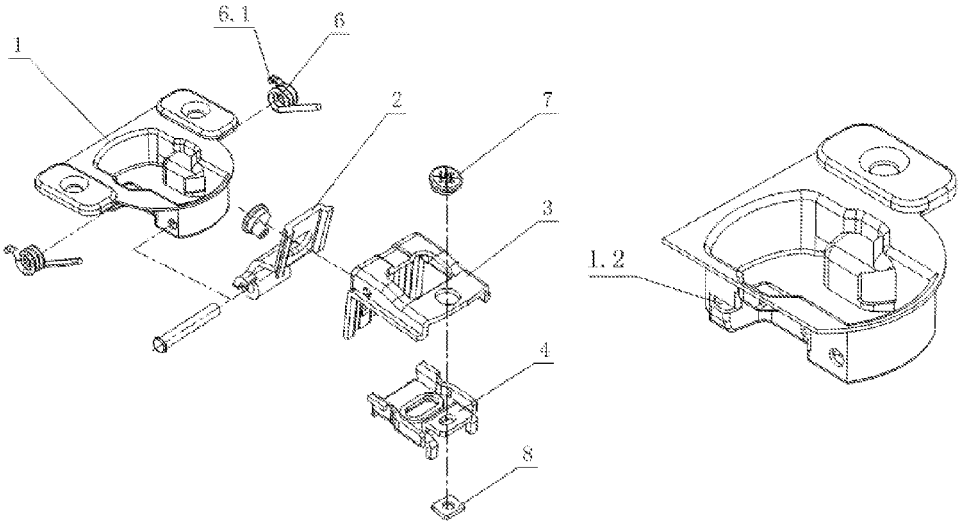
FIG. 1 is the breakdown structure diagram of an embodiment of the present utility model.
Figure 2:
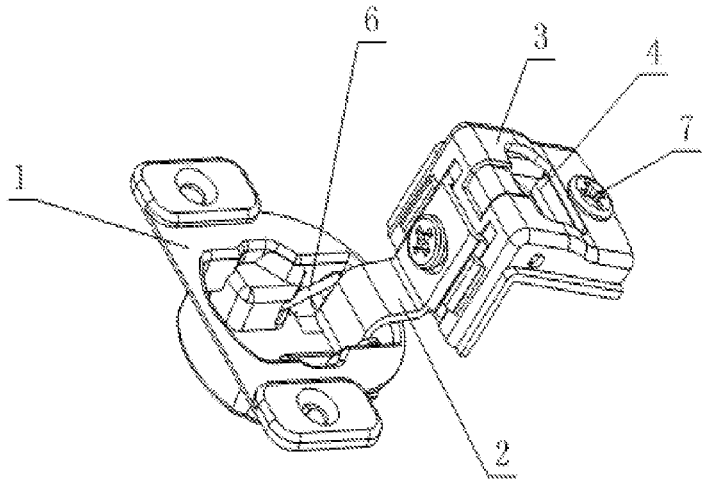
FIG. 2 is the combined structure diagram of an embodiment of the present utility model.
Figure 3:
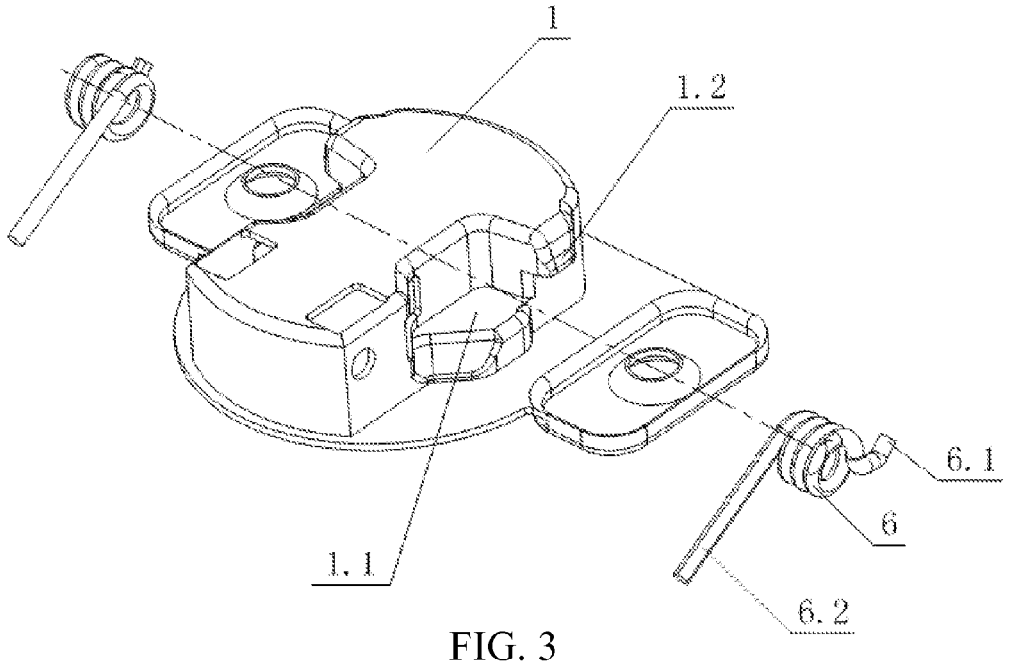
FIG. 3 is the breakdown structure diagram of the movable cup seat and the torsion spring in an embodiment.
Figure 4:
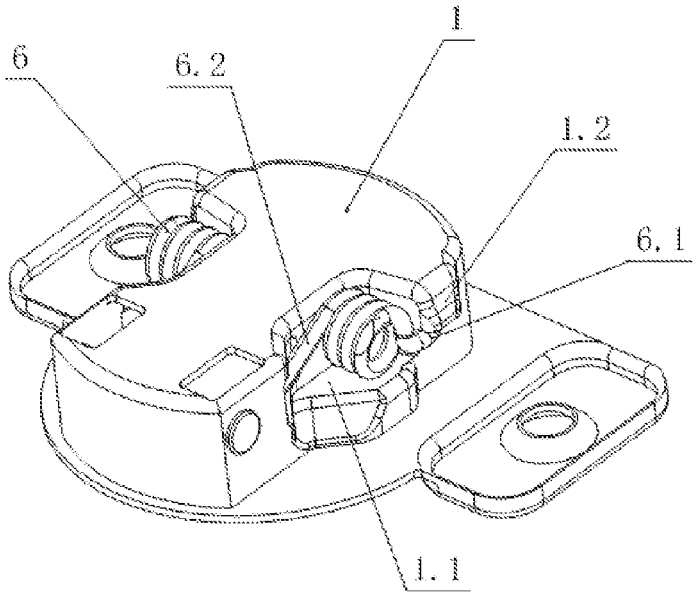
FIG. 4 is the combined structure diagram of FIG. 3.
Figure 5:
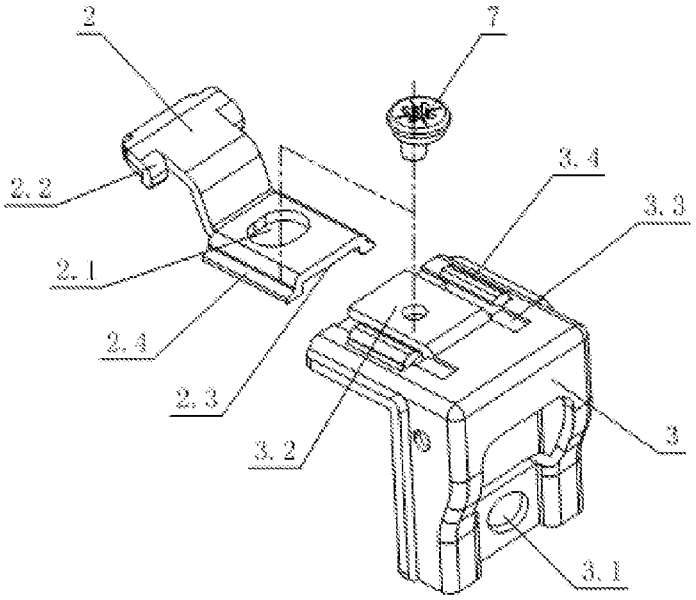
FIG. 5 is the breakdown structure diagram of the rotary arm and the connecting piece in an embodiment.
Figure 6:
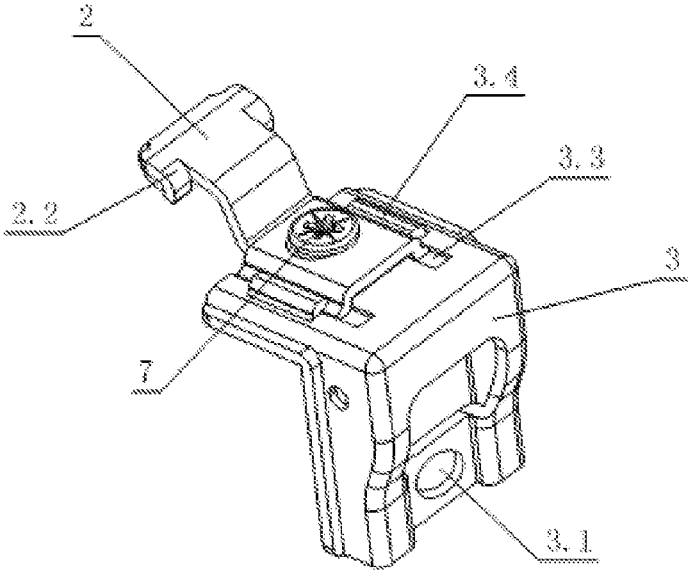
FIG. 6 is the combined structure diagram of FIG. 5.
Figure 7:
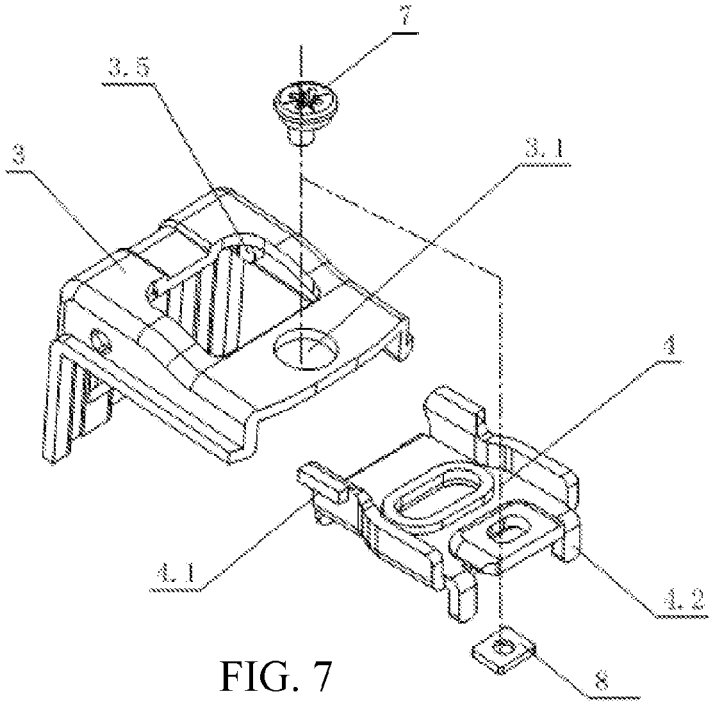
FIG. 7 is the breakdown structure diagram of the connecting piece and the movable plate in an embodiment.
Figure 8:
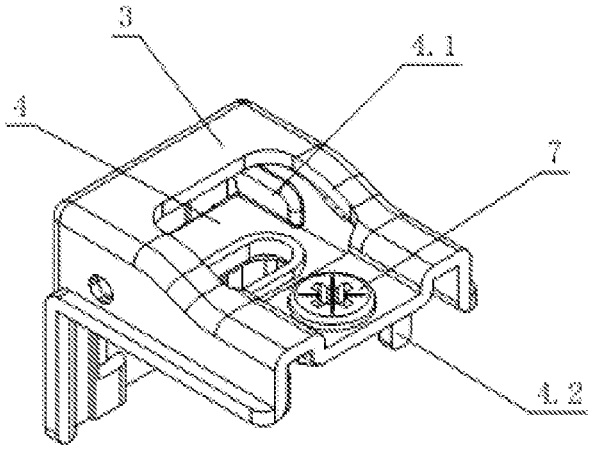
FIG. 8 is the combined structure diagram of FIG. 7.

Further detailed description of the present utility model is provided with reference to specific embodiments in combination with attached drawings.

The First Embodiment

With reference to FIGS. 1-8, A hinge used for furniture, comprising a movable cup seat 1 provided on the furniture door body, a regulating base provided on the main body of furniture, a rotary arm 2 connected between the movable cup seat 1 and the regulating base as well as a torsion spring designed to generate start-stop acting force on the movable cup seat 1 at least, wherein two torsion springs 6 are respectively mounted on the notches (1.1) on both sides at the bottom of the movable cup seat 1; The torsion spring 6 at least comprises a first supporting leg 6.1 with one end extending into the cup body of the movable cup seat 1 and being connected with it as well as a second supporting leg 6.2 with another end being extended into the cup body of movable cup seat and being connected with the rotary arm 2; the free end of the first supporting leg 6.1 is bent, a slot hole 1.2 is provided on the movable cup seat 1 corresponding to the first supporting leg 6.1, the first supporting leg 6.1 extends into the slot hole 1.2 and is connected with the bottom wall of the movable cup seat 1. The arm lever at one end of the rotary arm 2 is hinged with the movable cup seat 1 through pin shaft and forms an arc-shaped surface 2.2 which is connected with the second supporting leg 6.2 of the torsion spring 6, and the top surface at another end of rotary arm 2 is connected with the regulating base through the eccentric regulating rivet 7.

Specifically, the regulating base is composed of a connecting piece 3 and a movable plate 4, the connecting piece 3 is designed as L-shaped, one side of the connecting piece 3 is connected with the rotary arm 2 through one eccentric regulating rivet 7, and another side of the connecting piece 3 is connected with the movable plate 4 through another eccentric regulating rivet 7, so as to realize the two-dimensional regulation to the furniture door body. A first regulating hole 2.1 is provided on the rotary arm 2, a matching hole is provided on the connecting piece 3 corresponding to the first regulating hole 2.1, and both the first regulating hole 2.1 and the matching hole are in coordinated connection through the eccentric regulating rivet 7; A recess 2.3 is provided on the rotary arm 2, flanks 2.4 are extended on both sides of the recess 2.3, a boss 3.2 and a slide slot 3.3 are respectively on the connecting piece 3 corresponding to the recess 2.3 and the flanks 2.4, and both the boss 3.2 and the slide slot 3.3 are in sliding fit. A limiting bump 3.4 is also provided on the connecting piece corresponding to the flanks 2.4. A second regulating hole 3.1 is provided on the connecting piece 3, a matching hole is provided on the movable plate 4 corresponding to the second regulating hole 3.1, and both the second regulating hole 3.1 and the matching hole are in coordinated connection through another eccentric regulating rivet 7; The side walls of the connecting piece 3 are bent and squeezed inwards to form a boss 3.5, an open slot 4.1 is provided on the side wall of the movable plate 4 corresponding to the boss 3.5, and both the open slot 4.1 and the boss 3.5 are in sliding fit. Four corners of the movable plate 4 are bent downwards to form a claw 4.2, which is embedded into the main body frame of furniture to realize the positioning of the movable plate 4.

The rotary arm 2, the connecting piece 3 and the movable plate 4 are molded by integrated stamping and bending of metal.

The Second Embodiment

Figure 9:
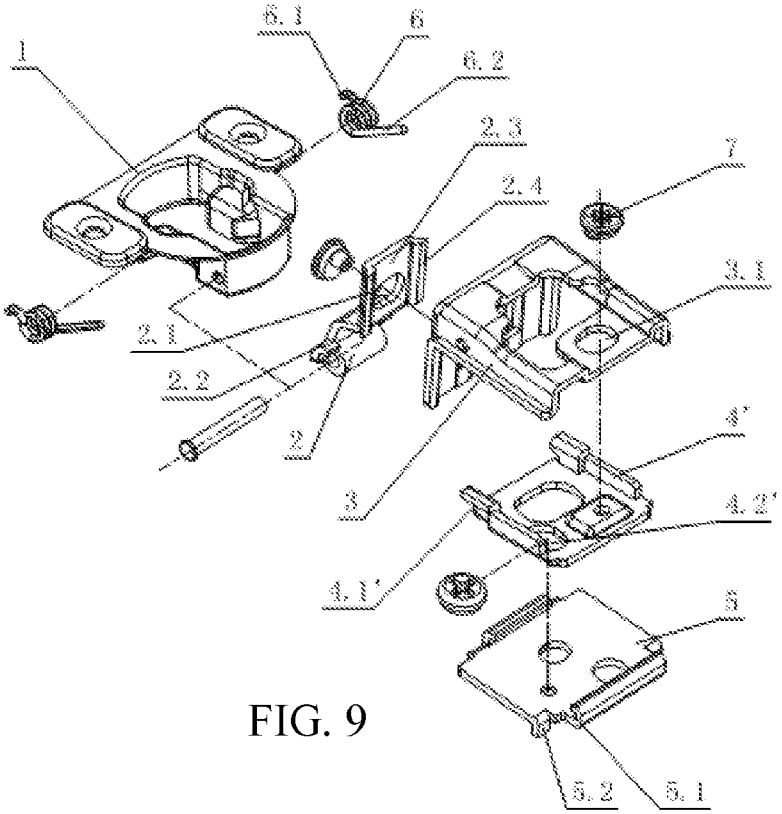
FIG. 9 is the breakdown structure diagram of the second embodiment of the present utility model.
Figure 10:
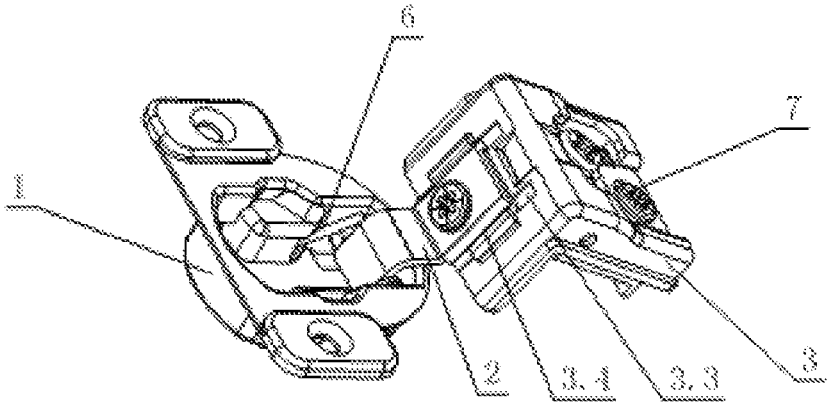
FIG. 10 is the combined structure diagram of the second embodiment of the present utility model.

With reference to FIGS. 9 and 10, the hinge used for furniture differs from the first embodiment in the following aspects: the regulating base is composed of a connecting piece 3 and movable plate 4' and a base plate 5, wherein the movable plate 4' is positioned between the connecting piece 3 and the base plate 5, the connecting piece (3) is designed as L-shaped, one side of the connecting piece 3 is connected with the rotary arm 2 through one eccentric regulating rivet 7, and the other side is connected with the movable plate 4' through another eccentric regulating rivet 7, the movable plate 4' is connected with the base plate 5 through another eccentric regulating rivet 7, so as to realize the three-dimensional regulation to the furniture door body.

Specifically, a first regulating hole 2.1 is provided on the rotary arm 2, a matching hole is provided on the connecting piece 3 corresponding to the first regulating hole, and both the first regulating hole 2.1 and the matching hole are in coordinated connection through the eccentric regulating rivet 7; a recess 2.3 is provided on the rotary arm 2, flanks 2.4 are extended on both sides of the recess 2.3, a boss 3.2 and a slide slot 3.3 are respectively provided on the connecting piece 3 corresponding to the recess 2.3 and the flank 2.4, and both the boss and the sliding slot are in sliding fit; a limiting bump 3.4 is provided on the connecting piece 3 corresponding to the flanks 2.4. A second regulating hole 3.1 is provided on the connecting piece 3, a matching hole is provided on the movable plate 4' corresponding to the second regulating hole 3.1, and both the second regulating hole and the matching hole are in coordinated connection through another eccentric regulating rivet 7; the side walls of the connecting piece 3 are bent and squeezed inwards to form a boss 3.5, an open slot 4.1' is provided on the side wall of the movable plate 4' corresponding to the boss 3.5, and both the boss 3.5 and the open slot 4.1' are in sliding fit. A third regulating hole 4.2' is provided on movable plate 4', a matching hole is provided on the base plate 5 corresponding to the third regulating hole 4.2', and both the third regulating hole and the matching hole are in coordinated connection through another eccentric regulating rivet 7; the outside of the base plate 5 is bent towards the direction of movable plate 4' and forms a guide slot 5.1, the movable plate 4' is slideably mounted on guide slot 5.1, four corners of base plate 5 are bent downwards to form a blocking part 5.2, which is embedded in the main body frame of furniture to realize the positioning of base plate 5.

The rotary arm 2, the connecting piece 3, the movable plate 4' and the base plate 5 are molded by integrated stamping and bending of metal.

The other parts which are not described are the same as those of the first embodiment.

The preferred embodiments of the present utility model are described above. All the simple modifications or transformations made by those skilled in the art to these embodiments fall within the claims of the present utility model.

It is claimed:

1. A blind hinge used for furniture, comprising a movable cup seat-configured to couple to a furniture door body, a regulating base configured to couple to a main body of furniture, a rotary arm connected between the movable cup seat and the regulating base as well as at least one torsion spring mounted on at least one notch on a side of the movable cup seat and designed to generate start-stop acting force on the movable cup seat at least, wherein the at least one torsion spring comprises a first supporting leg with one end extending into and connecting with a cup body of the movable cup seat and a second supporting leg with another end extending into the cup body of the movable cup seat and being connected with the rotary arm; wherein a free end of the first supporting leg is bent, at least one slot hole is provided on the movable cup seat corresponding to the first supporting leg, which extends into the slot hole and is connected with an end surface of a side wall protruding from a midportion of the movable cup seat.

2. The hinge used for furniture of claim 1, wherein an arm lever at one end of the rotary arm is hinged with the movable cup seat and forms an arc-shaped surface which is connected with the second supporting leg of the at least one torsion spring, and a top surface at another end is connected with the regulating base through a first eccentric regulating rivet.

3. The hinge used for furniture of claim 2, wherein the regulating base is composed of a connecting piece and a movable plate, wherein the connecting piece is designed as L-shaped, one side of the connecting piece is connected with the rotary arm through the first eccentric regulating rivet, the opposite side of the connecting piece is connected with the movable plate through a second eccentric regulating rivet.

4. The hinge used for furniture of claim 3, wherein a first regulating hole is provided on the rotary arm, a matching hole is provided on the connecting piece corresponding to the first regulating hole and both the first regulating hole and the matching hole are in coordinated connection through the first eccentric regulating rivet, a recess is provided on the rotary arm, at least one flank is extended on at least one side of the recess, a boss and a sliding slot are respectively provided on the connecting piece wherein the boss corresponds to the recess and the sliding slot corresponds to the at least one flank and a limiting bump provided on the connecting piece corresponding to the flank.

5. The hinge used for furniture of claim 4, wherein a second regulating hole is provided on the connecting piece, a second matching hole is provided on the movable plate corresponding to the second regulating hole, and both the second regulating hole and the second matching hole are in coordinated connection through the second eccentric regulating rivet; wherein at least one side wall of the connecting piece is bent and squeezed inwards to form a second boss, an open slot is provided on a side wall of the movable plate corresponding to the second boss, and both the second boss and the open slot are in sliding fit; wherein at least two corners of the movable plate are bent downwards to form a claw.

6. The hinge used for furniture disclosed in claim 3, wherein both the rotary arm and the regulating base are molded by integrated stamping and bending of metal.

7. The hinge used for furniture disclosed in claim 4, wherein both the rotary arm and the regulating base are molded by integrated stamping and bending of metal.

8. The hinge used for furniture disclosed in claim 5, wherein both the rotary arm and the regulating base are molded by integrated stamping and bending of metal.

9. The hinge used for furniture of claim 2, wherein the regulating base is composed of a connecting piece and movable plate and a base plate, wherein the movable plate is positioned between the connecting piece and the base plate, the connecting piece is designed as L-shaped, wherein one side of the connecting piece is connected with the rotary arm through the first eccentric regulating rivet, and the other side is connected with the movable plate through a second eccentric regulating rivet, the movable plate is connected with the base plate through third eccentric regulating rivet.

10. The hinge used for furniture of claim 9, wherein a first regulating hole is provided on the rotary arm, a matching hole is provided on the connecting piece corresponding to the first regulating hole and both the first regulating hole and the matching hole are in coordinated connection through the first eccentric regulating rivet, a recess is provided on the rotary arm, at least one flank extended on at least one side of the recess, a boss-and a sliding slot are respectively provided on the connecting piece wherein the boss corresponds to the recess and the sliding slot corresponds to the at least one flank; and a limiting bump provided on the connecting piece corresponding to the flank.

11. The hinge used for furniture of claim 10, wherein a second regulating hole is provided on the connecting piece, a second matching hole is provided on the movable plate corresponding to the second regulating hole, and both the second regulating hole and the second matching hole are in coordinated connection through the second eccentric regulating rivet; wherein at least one side wall of the connecting piece is bent and squeezed inwards to form a second boss, an open slot is provided on a side wall of the movable plate corresponding to the second boss, and both the second boss and the open slot are in sliding fit; a third regulating hole is provided on the movable plate, a third matching hole is provided on the base plate corresponding to the third regulating hole, and both the third regulating hole and the third matching hole are in coordinated connection through the third eccentric regulating rivet; at least one side edge of the base plate is bent towards the movable plate to form a guide slot, the movable plate is slideably provided on a guide slot, and at least two corners of the base plate are bent downwards to form a blocking part.

12. The hinge used for furniture disclosed in claim 9, wherein both the rotary arm and the regulating base are molded by integrated stamping and bending of metal.

13. The hinge used for furniture disclosed in claim 10, wherein both the rotary arm and the regulating base are molded by integrated stamping and bending of metal.

14. The hinge used for furniture disclosed in claim 11, wherein both the rotary arm and the regulating base are molded by integrated stamping and bending of metal.

15. The hinge used for furniture disclosed in claim 2, wherein both the rotary arm and the regulating base are molded by integrated stamping and bending of metal.

16. The hinge used for furniture disclosed in claim 1, wherein both the rotary arm and the regulating base are molded by integrated stamping and bending of metal.

* * * * *